United States Patent [19]

Falcione

[11] 4,165,077

[45] Aug. 21, 1979

[54] WORD GAME

[76] Inventor: Ronald D. Falcione, 17 Old Pottery Ln., Norwell, Mass. 02061

[21] Appl. No.: 785,065

[22] Filed: Apr. 6, 1977

[51] Int. Cl.[2] ..... A63F 3/00

[52] U.S. Cl. ..... 273/239; 273/265; 273/272

[58] Field of Search ..... 273/130 A, 130 AC, 130 E, 273/131 G, 135 AD, 135 D, 136 B, 136 E, 137 AE, 272, 239, 265

[56] References Cited

U.S. PATENT DOCUMENTS

| | | | |
|---|---|---|---|
| 1,592,252 | 7/1926 | Beckwith | 273/135 D |
| 3,427,028 | 2/1969 | Abrahamsen | 273/135 D |
| 3,524,648 | 8/1970 | Nilan | 273/130 A |
| 3,948,526 | 4/1976 | Lukacik | 273/136 B |

*Primary Examiner*—Anton O. Oechsle
*Attorney, Agent, or Firm*—Kenway & Jenney

[57] ABSTRACT

A word game comprising a plurality of tiles and a tile support means having an intersecting pattern of at least one row and at least one column of tile receiving spaces is disclosed. The object of the game is to determine the word combinations chosen by the other players to fill their tile supports.

7 Claims, 4 Drawing Figures

FIG. 1
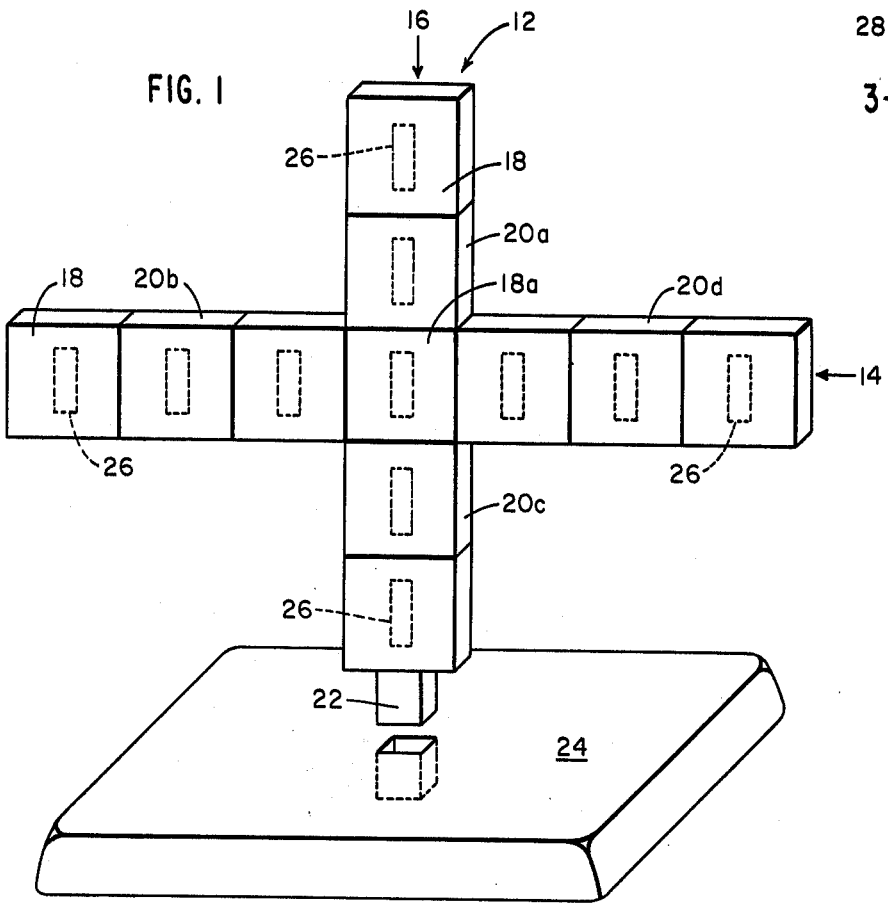
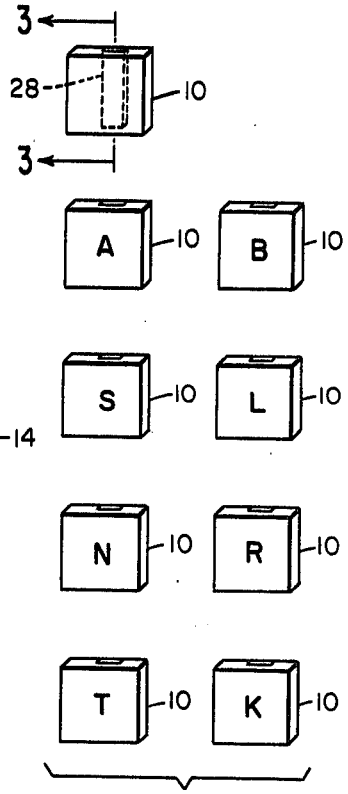
FIG. 2
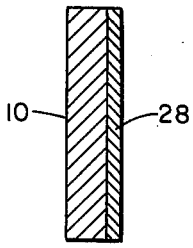
FIG. 3
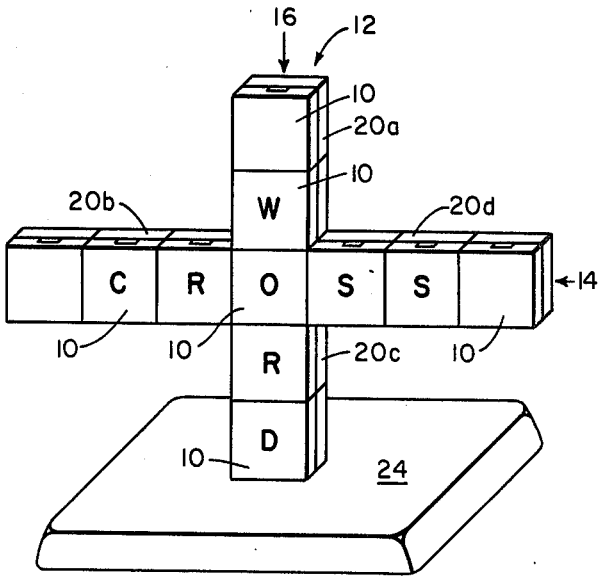
FIG. 4

WORD GAME

This invention relates to word games and in particular to a word game for two or more players in which the object is to guess the other opposing players' word combinations.

BACKGROUND OF THE INVENTION

Many of the word and number games presently available are complex or difficult to learn. Consequently, it is hard for players of different ages and experiences, for example, father and son, or mother and daughter, to equally enjoy the competition of the games due to the superior vocabularly and mathematical ability which is generally acquired with age. On the other hand, there are also available many simple games which unfortunately do not challenge the interest of both young and old.

It is therefore an object of the present invention to provide a word game which is easy to learn and play, which minimizes the experience and superior intellect generally acquired with age, and which provides strategies which can be understood and enjoyed by persons of all ages. Other objects of the invention are to provide a simple low cost word game which can be mass produced and which appeals to persons of all ages.

Yet a further object of the invention is to provide a game in which the rules can be easily varied to match the abilities of the players.

SUMMARY OF THE INVENTION

The invention features a word game having a plurality of tiles, the majority of the tiles having alphabetic characters displayed thereon and the remaining tiles being blank. The invention further comprises a tile support means having a plurality of tile receiving spaces for supporting the tiles in a readable manner whereby the alphabetic characters, if any, can be seen. The spaces are arranged in an intersecting pattern of at least one row and one column of spaces with one of the spaces, the center space, being at an intersection of the one row and one column. Preferably, a base is provided which operatively cooperates with a mating portion of the tile support means to orient the support means in a vertical direction.

According to the rules of the word game, each player chooses words which can be placed in the rows and columns in the support means thereby forming a word-cross combination. A first player then asks a selected opposing player (who may be the only opposing player) whether his word-cross combination has a specific symbol, an alphabetic character or a blank. If the particular selected player has that symbol in one or more heretofore unrevealed positions in his word-cross, he discloses one position (even if he has more than one still unrevealed in his word-cross) by placing a tile bearing that symbol in a corresponding space of his tile support means. If a player correctly guesses a symbol of an opposing player's word-cross, he takes another turn. If he guesses wrong, the next successive player takes his turn and play continues until the word-cross combination of one player only is not entirely revealed on his tile support means. Thus, the last person to have a support means in which there are unfilled spaces wins the game. In a preferred variation of the game, a player cannot ask another player for a vowel until at least a predetermined number (preferably three) of other tiles have been placed on the selected player's support means and if a vowel is incorrectly guessed, the asking player loses not only his present turn but his next turn as well.

DESCRIPTION OF THE DRAWINGS

Other objects, features and advantages of the invention will appear from the following description of a preferred embodiment taken together with the drawings in which:

FIG. 1 is a perspective view of a preferred tile support means according to the invention;

FIG. 2 is a perspective view of a plurality of tiles according to a preferred embodiment of the invention;

FIG. 3 is a cross-sectional view along 3—3 of FIG. 2; and

FIG. 4 is one possible word-cross combination according to the invention.

DESCRIPTION OF A PREFERRED EMBODIMENT

Referring to FIGS. 1 and 2, the word game according to the invention comprises a plurality of tiles 10 bearing symbols, either alphabetic characters or blanks, which are adapted to be received or secured on a tile support means 12. The support means 12, in the preferred embodiment, is constructed in an intersecting relationship of a row structure 14 and a column structure 16. In other embodiments, a plurality of rows and/or columns might be used, each comprising a plurality of tile receiving spaces 18.

In the preferred embodiment, support means 12 has a center tile receiving space **18*a*, and four mutually perpendicular arms 20*a*, 20*b*, 20*c*, 20*d*, each having a plurality of tile receiving spaces 18. The arms are connected to the center space in any way known in the art for example by adhesive cement, to form tile support means 12. A support leg 22, connected to support arm 20*c*, is provided for supporting and orienting the tile support means vertically in a stationary base 24**.

Preferably, tile support means 12 is constructed to magnetically support tiles 10. Thus, behind each space 18 there is provided a magnet 26 to attract and hold tiles 10 which correspondingly are constructed of or at least include a magnetizable material for example, portions 28, which are thin strips of an iron containing material. Alternatively, a material such as Velcro or a mechanical arrangement could be used. The remainder of the tiles and the tile support means and base may be constructed of any suitable material, for example wood or plastic.

The word game described in detail hereinafter is called "WORD-CROSS". The object of the word-cross game is to completely fill the spaces of each opponent's tile support means. Initially, each player selects a combination of words which will fit in the spaces of his tile support means. Only one word is allowed within each row or column and the intersection of each row or column must contain an alphabetic character. A word-cross code pad or other writing pad may be used to record the word-cross combination.

According to the preferred embodiment wherein there is one row and one column, the row word may contain as many as seven letters and as few as one letter and the column word may contain as many as five letters or as few as one letter. An example of a typical word-cross combination is shown in FIG. 4. In those circumstances where a word does not fill all of the spaces provided, a blank is used and may be placed at the beginning of the word, at the end, or if the word is short enough, at both the beginning and end of the word.

The players, having selected their word-cross combinations (generally referred to as a word-cross), then take turns in order, and sequentially ask a selected opponent if he has a particular letter or blank in his word-cross. If the selected opponent's word-cross includes the symbol, he proceeds to put a tile bearing that symbol into the space in his tile supporting means at a position in which the symbol appears. If his word-cross includes the symbol more than once, he chooses and discloses only one of the spaces having the symbol. When a player makes a correct guess, he is entitled to take another turn and continues to ask for symbols until he makes an incorrect guess. The play of the game continues in this fashion, requesting blanks or letters, until the complete word-cross of only one player is not fully disclosed. That player wins the game.

In a preferred variation of the rules described above, a player cannot request a vowel from a selected opponent until that opponent has already revealed, in his tile support means, at least a predetermined number (preferably three) of tiles, either letters or blanks. If a player then properly requests a vowel, but is incorrect, that player not only loses his present turn, but his next turn as well.

Other embodiments of the invention including variations of the rules or modifications of the structure of either the tile support means or the tiles will appear to those skilled in the art and are within the following claims.

What is claimed is:

1. A word game method associated with
   - a plurality of tiles, the majority of said tiles having alphabetic characters displayed thereon and the remaining tiles being blank, and
   - a plurality of tile support means having a plurality of tile receiving spaces for supporting the tiles in an intersecting pattern of at least one column and at least one row, whereby each tile can be supported so that its indicia bearing portion, if any, can be read, and one of said spaces being at an intersection of each row and column, and the rules of the game method comprising the following steps:

- each player chooses words which can be placed in each row and column of the tile support means thereby forming a word-cross combination,
- a first player asks a selected opposing player whether his word-cross combination has a specific symbol,
- if a particular selected player has that symbol in one or more heretofore unrevealed positions of his word-cross, he discloses one position by placing a tile bearing that symbol in a corresponding space in his tile support means,
- if a player guesses correctly he guesses again,
- if a player guesses incorrectly, the next successive player takes his turn, and
- play continues until the tile support means of one player only is not entirely covered with tiles.

2. The word game method of claim 1 further comprising the step of magnetically supporting said tiles.

3. The word game of claim 1 further comprising the step of providing one row and one column for said tile support means.

4. The word game of claim 3 further comprising the step of providing the row with seven spaces and the column with five spaces.

5. The word game method of claim 1 further comprising the step of vertically orienting said tile support means on a base cooperatively associated therewith.

6. The word game method of claim 1 further comprising the steps of
   - requesting a vowel of a selected player only after at least a predetermined number of other tiles have been placed on the selected player's support means and
   - losing a next turn if the vowel is incorrectly requested.

7. The method of claim 6 further including the step of requesting a vowel only after at least three other tiles have been placed on the selected player's support means.

* * * * *